US006080993A

United States Patent [19]

Zwijsen

[11] Patent Number: 6,080,993

[45] Date of Patent: Jun. 27, 2000

[54] DETECTION OF TYPE OF DYE DONOR ELEMENT IN A THERMAL PRINTING SYSTEM

[75] Inventor: Jan Zwijsen, Wilrijk, Belgium

[73] Assignee: Agfa-Gevaert, N.V., Mortsel, Belgium

[21] Appl. No.: 08/226,684

[22] Filed: Apr. 12, 1994

[30] Foreign Application Priority Data

Apr. 14, 1993 [EP] European Pat. Off. ..... 93201085

[51] Int. Cl.[7] ..... B41J 17/36

[52] U.S. Cl. ..... 250/548; 250/559.4; 347/178; 400/240.3

[58] Field of Search ..... 250/566, 568, 250/571, 561, 221, 222.1, 226, 548, 559.4; 347/178, 176, 174, 185, 211, 212, 214, 217; 400/240.3, 240.4, 240, 237, 224.2, 120.01, 120.02, 120.04

[56] References Cited

U.S. PATENT DOCUMENTS 4,551,729 11/1985 Kubo et al. ..... 347/178
4,573,059 2/1986 Shinma et al. ..... 347/178
4,590,490 5/1986 Takanashi et al. ..... 347/176
4,642,655 2/1987 Sparer et al. ..... 347/178
5,169,828 12/1992 Janssens et al. ..... 503/227
5,208,464 5/1993 Yonemoto et al. ..... 250/561
5,376,618 12/1994 Uytterhoeven et al. ..... 503/227

*Primary Examiner*—John R Lee
*Attorney, Agent, or Firm*—Breiner & Breiner

[57] ABSTRACT

The present invention provides a thermal printing system equipped with at least 3 light sources and 3 photodetectors positioned opposite thereto for detecting the type of dye donor element. One of said light source illuminates a dye frame whereas the other illuminate detection marks in a margin of the dye donor element. The thermal printing system according to the invention allows to distinguish between a dye donor element for color printing and black and white printing and according to an embodiment is also capable to detect further variants. The present invention further provides a dye donor element for use in such thermal printing system and to a method for detecting the type of dye donor element.

7 Claims, 7 Drawing Sheets

DETECTION OF TYPE OF DYE DONOR ELEMENT IN A THERMAL PRINTING SYSTEM

DESCRIPTION

1. Field of the Invention

The present invention relates to a thermal printing system for printing black and white or color images using a dye donor element containing heat transferable dyes. More particularly, this invention relates to the detection of the type of dye donor element e.g. black and white or color, and the type of dye frame when a series of different dye frames is used.

2. Background of the Invention

In one type of thermal printer which prints colored images, a dye donor element may contain a repeating series of dye frames of differently colored heat transferable dyes or alternatively the thermal printer may be used for printing black and white images using a dye donor element containing a continuous dye frame comprising a mixture of heat tranferable dyes of different color so as to obtain black.

In such a thermal printer the dye donor element and a suitable image receiving material, e.g. a coated paper or coated polyester substrate, are contacted with each other and an image is formed on the image receiving material by heating the back of the dye donor element with a thermal head formed of, for example a plurality of individual heating elements. When a particular heating element is energized it is heated and causes dye from the dye donor element to transfer to the image receiving material. The density or darkness of the printed image is a function of the energy delivered from the heating element to the dye donor element.

Alternatively heating of the dye donor element may be carried out with a laser. Such heating method is known as laser induced dye transfer.

Thermal dye transfer printers offer the advantage that they can yield true "continuous tone" dye density tranfer. This result is obtained by varying the energy applied to each heating element, yielding a variable dye density image pixel on the receiver material. However, several factors play a role in this process and may influence the quality of the transferred image and the continuous tone obtained. Such factors are e.g. the type of dyes or mixture thereof used, type of binder used in the dye layer, type of image receiving material etc.

As a consequence thereof it may be necessary to use dye donor elements that vary in constitution from one application to another. For example, a different type of dye donor element might be used with an opaque image receiving material than with a transparent receiving material.

Furthermore, it will generally be necessary to apply corrections to the image data before these data are used to obtain an image of high quality. Type and extent of corrections will also depend on the particular dye donor element being used. For example a different type of correction will generally be necessary when printing a black and white image using a black dye donor element than when a color image is being printed with a dye donor element having a series of differently colored dye frames.

Finally, when a color image is to be printed using a dye donor element having a series of differently colored dye frames it will be necessary to identify the particular dye frame. For example a typical dye donor element may include a series of yellow, magenta and cyan dye frames. In a process for printing a colored image therewith the yellow frame is first positioned under the print head, e.g. a thermal head or a laser to print yellow image pixels on the receiver material. Next, the magenta dye frame needs to be positioned under the print head to print a magenta image on top of the yellow image on the receiver and finally the cyan dye frame is positioned under the print head to print the cyan part of the image.

Thus it will be important to identify the leading yellow dye frame of each series and subsequently identify at least when another dye frame comes under the print head.

It will further be clear that the above referred detections may not interfere with each other, in particular the main detections i.e. the type of dye donor element and leading dye frame in case of a series of dye frames may only occur once.

SUMMARY OF THE INVENTION

It is an object of the present invention to provide a thermal printing system that is capable of distinguishing between a dye donor element for printing color images and one for printing black and white images and that is at the same time capable of identifying different dye frames of a dye donor element for printing color images.

It is a further object of the present invention to provide a thermal printing system that is also capable of identifying different variants of dye donor elements for printing black and white images and for color images e.g. dye donor elements that are intended for use with an opaque or transparent image receiving material.

Further objects of the present invention will become clear from the description hereinafter.

According to the present invention there is provided a thermal printing system including a printer which uses a dye donor element having one or more dye frames and a receiver which receives dyes from said dye frames, said printer including a print head, means for moving said dye donor element and receiver along respective paths so as to move a dye frame and the receiver relative to the print head such that as the print head is activated, dye from a dye frame is transferred to the receiver to form an image thereon characterized in that detecting means are provided for indentifying type of dye donor element and type of dye frame, said detecting means comprising:

- a first light source disposed adjacent to the path of the dye donor element for illuminating a dye frame of the dye donor element
- two further light sources positioned in sequence and disposed adjacent to the path of the dye donor element for illuminating repetitive detection areas occurring at a regular distance in a margin of the dye donor element, each of said detection areas being transparent or opaque for one or both light sources
- a first photodetector disposed adjacent to the path of the dye donor element and opposite to said first light source said first photodetector producing an electrical signal in response to the intensity of light emitted by said first light source and passing through said dye frame
- two further photodetectors positioned in sequence, disposed adjacent to the path of the dye donor element and each being opposite to one of said two further light sources, each of said two further photodetectors producing an electrical signal in response to the intensity of light emitted by the light source being opposite to it and passing through said detection areas
- each of said photodectors producing a logical signal when an intensity is detected above or below a threshold value set for said photodetector and means responsive to said logical signals of said photodetectors for identifying the type of dye frame and type of dye donor element.

Suitable light sources for use in connection with the present invention are e.g. LEDs, the ends of optic fibers illuminated by a suitable light source, fluorescent panels etc.

The present invention also provides a method of printing images using the above described printing system.

BRIEF DESCRIPTION OF THE DRAWINGS

The present invention will be described hereinafter by way of example with reference to the accompanying drawings wherein:

FIG. 1 shows a schematic drawing of one embodiment of a thermal printing system in connection with the present invention and dye donor elements containing in one of its margins detection areas. Specifically.

FIGS. 4 and 5 show a schematic drawing of detections that allow detection of variants of black and white or color dye donor elements. More specifically.

DETAILED DESCRIPTION OF THE INVENTION

The print head in connection with the present invention can be any means for causing image-wise heating such as e.g. a laser or a print head having a plurality of selectively energizable heating elements. The latter is preferred in the present invention and is also used to illustrate the invention in the following description.

Figure 1A:
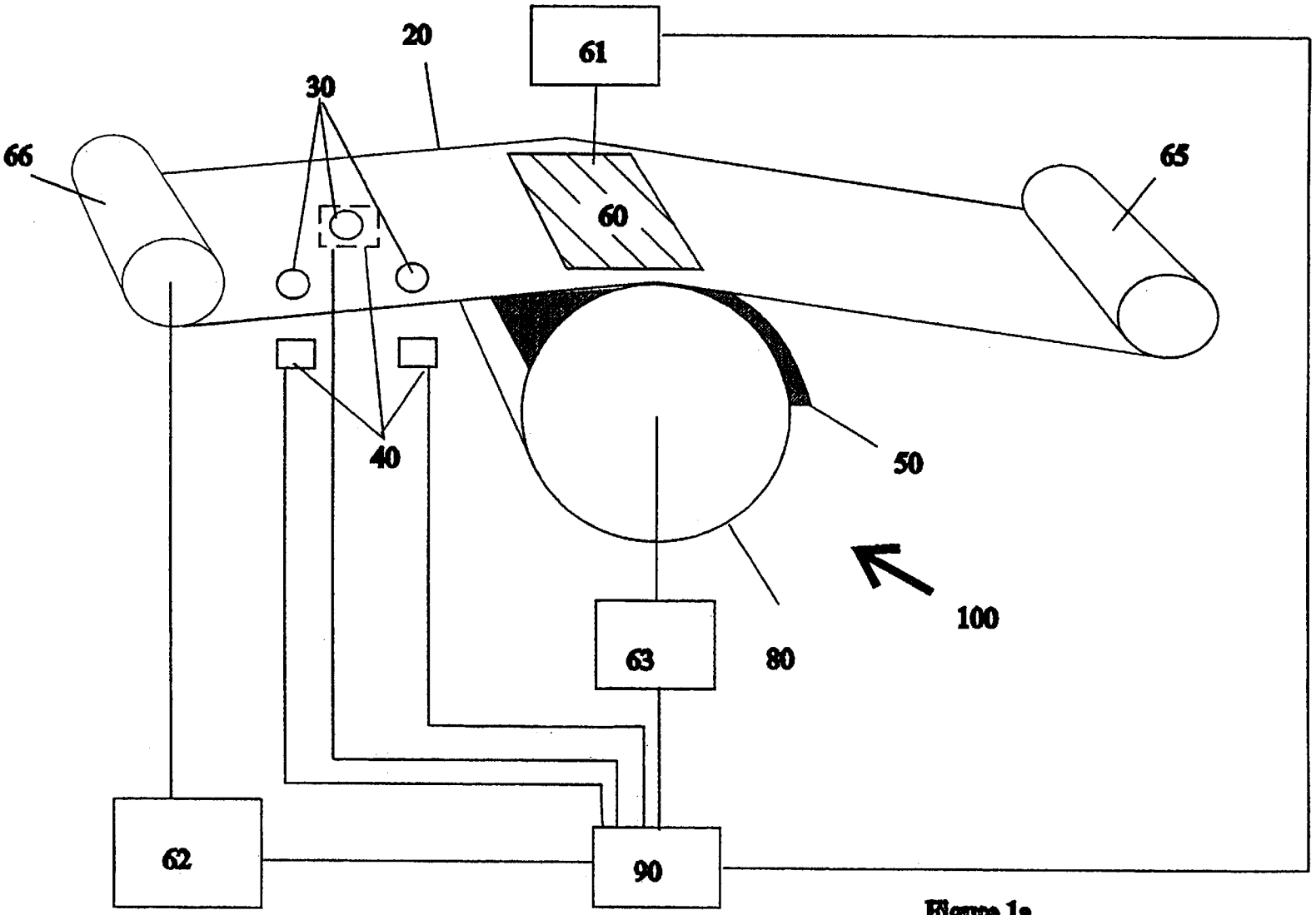
FIG. 1*a* shows a schematic representation of a thermal printer which uses a receiver and a dye donor element.

The general working of a thermal printing system in connection with the present invention will first be explained referring to FIGS. 1*a* to 1*c*. FIG. 1*a* shows a schematic representation of a thermal printer (100) which uses a receiver (50) and a dye donor element (20). The receiver (50) in the form of a sheet is secured to a rotatable drum (80) which is mechanically coupled to a drive mechanism (63) that continuously advances the receiver (50) along a path passing a stationary print head (60). Print head (60) has a plurality of heating elements (not shown) that can be selectively energized by a micro computer (90) providing signals to a print head control circuit (61). Dye donor element (20) is supplied from suply roller (65) and can be continuously advanced by drive mechanism (62) mechanically coupled to take-up roller (66). Micro-computer (90) controls drive mechanisms (62) and (63).

Light emitted by LEDs (30) passing through the dye donor element is detected by photodetectors (40). Photodetectors (40) provide a logical signal 0 or 1 to micro computer (90) depending on whether the intensity of the detected light is above or below (or vice versa) a threshold value.

As will be described in more detail in the embodiments following, the logical signals provided by one or more photodetectors (40) are used for positioning dye donor element (20) in its start positioning for printing an image. This positioning may be carried out under the control of micro-computer (90) that can use the logicals coming from photodetectors (40) to control drive mechanism (62) for advancing dye donor element (20). Thus until a certain logical pattern from photodetectors (40) matches a predetermined pattern micro-computer (90) will provide signals to drive mechanism (62) to advance dye donor element (20).

Micro computer (90) also positions receiver (50) to its home position by controlling drive mechanism (63). Once positioning of dye donor element and receiver has been carried out the printing process can start in accordance with the type of dye donor element detected. Micro computer (90) controls the printing process in accordance with a logical signals pattern provided by photodectors (40) of which details are given below.

Figure 1C:
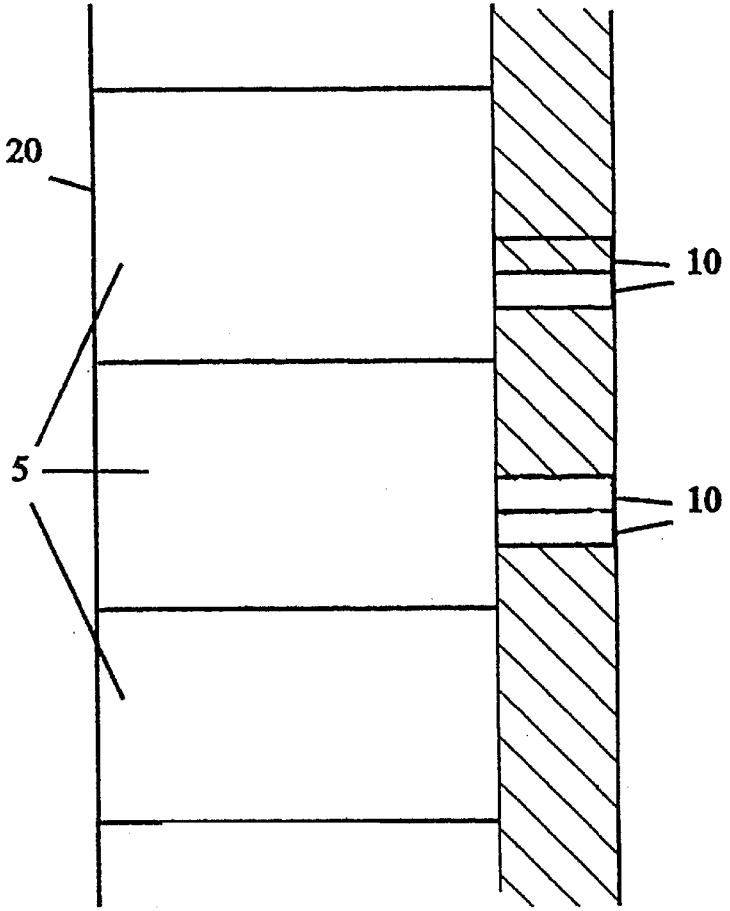
FIG. 1*c* shows a dye donor element with the margin dyed.
Figure 1B:
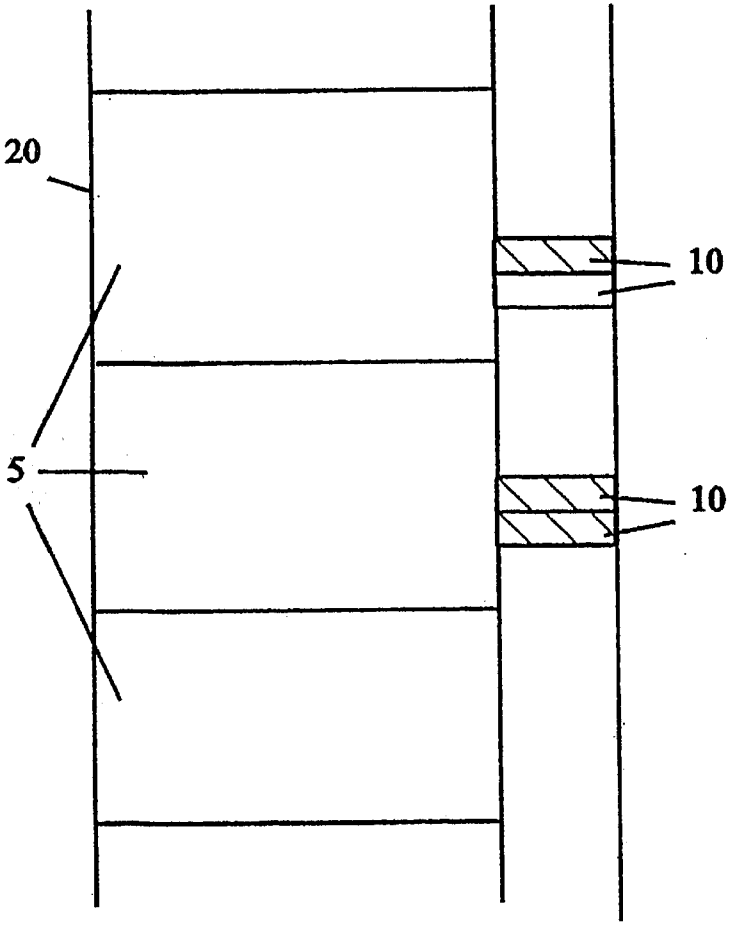
FIG. 1*b* shows a dye donor element containing repeating dye frames.

In FIG. 1*b* there is shown a dye donor element containing repeating dye frames (5) suitable for use in connection with the present invention. Detection areas (10) suitable for use in connection with the present invention are preferably contained in the same margin (15) of a dye donor element (20). Such detection areas are transparent or made opaque to at least one of the LEDs used for illuminating the detection areas (10). For example a cyan area may be used in conjunction with a red LED. The detection areas (10) in a margin of the dye donor element occur at a regular distance from each other. As shown in FIG. 1*a* the margins may be transparent and contain therein the detection areas. However most preferaby the margin is dyed e.g. with the same color as an opaque detection areas (shown by arcing in the figures). Such type of dye donor element is shown in FIG. 1*c*. An advantage of this type of dye donor element is the fact that when the dye donor element is wounded no deformations at the ends of the role occur whereas in case the margin is not dyed the thickness of the role will be less at one end of the role leading to deformation.

A dye donor element as shown in FIGS. 1*b* or 1*c* can be used in combination with 3 LEDs and photodetectors to detect between a dye donor element for black and white printing or for color printing and at the same time identification of a dye frame in color printing is possible. A way of detection according to a particular embodiment will be explained using FIGS. 2 and 3.

Figure 2:
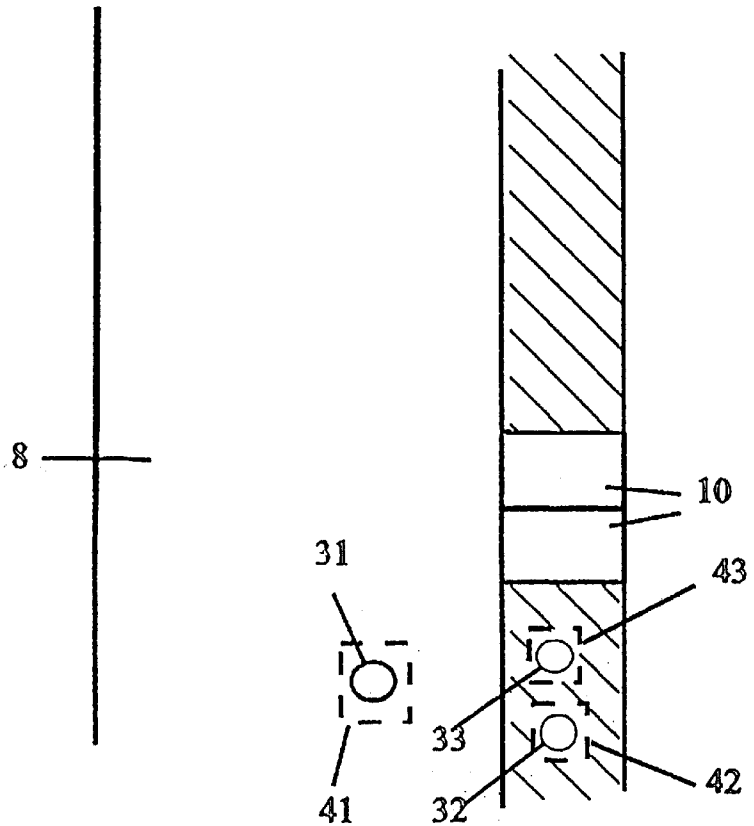
FIG. 2 shows a schematic drawing for a detection of a dye donor element for black and white printing that can be used in connection with the present invention.

FIG. 2 shows a schematic representation of a dye donor element containing a continuous black dye frame (8). There are further shown a LED (31) for illuminating the black dye frame (8), a corresponding photodetector (41) opposite to said LED (31) and two LEDs (32) and (33) for illuminating the detection areas (10) and the corresponding photodetectors (42) and (43) opposite of the LEDs (32) and (33). In the assumption that the dye donor element is in the position relative to the LEDs as shown in FIG. 2 and that the direction of transportation is as shown by the arrow in FIG. 2, the logical signals shown in table 1 will be provided by the photodetectors (42) and (43). A logical signal of 0 is assumed if the light emitted by a LED passes through the margin or detection areas of the dye donor element and 1 if not.

TABLE 1

| photodetector (42) | photodeteotor (43) |
|---|---|
| 1 | 1 |
| 1 | 0 |
| 0 | 0 |
| 0 | 1 |

Upon start-up, for example after power-up or resetting of the printer, the dye donor element will be moved until both photodetectors (42) and (43) yield logical signal 0. The logical signal provided by photodetector (41) is then used to identify the type of donor element. Since the dye frame is black and therefore opaque to a LED a logical 1 will be provided by photodetector (41) which signals the printer that black and white printing is to be carried out.

Figure 3:
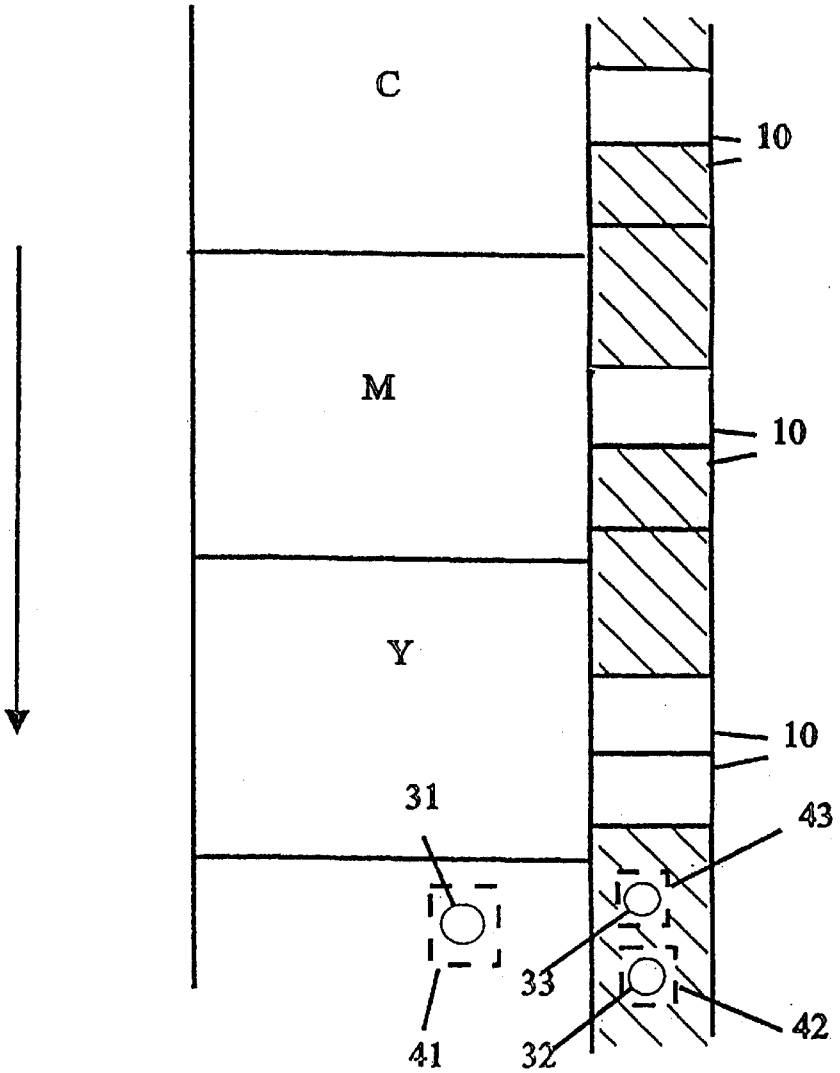
FIG. 3 shows a schematic drawing for a detection of a dye donor element for color printing that can be used in connection with the present invention.

Turning now to FIG. 3. FIG. 3 shows a dye donor element for color printing containing a sequence of yellow (Y), magenta (M) and cyan (C) dye frames. Further shown are LEDs (31), (32) and (33) together with their corresponding photodetectors (41), (42) and (43). As shown in FIG. 3 the detection areas along the yellow dye frame are both transparent whereas one of the detection areas along the other dye frames is made opaque to LEDs (32) and (33). For example a red LED could be used as LEDs (32) and (33) when a cyan area is used. Assuming that the margin outside the marking areas is also made opaque to the LEDs (32) and (33) the logical signals shown in table 2 will result (direction of transportation as shown).

TABLE 2

| photodetector (42) | photodetector (43) |
|---|---|
| 1 | 1 |
| 1 | 0 |
| 0 | 0 |
| 0 | 1 |
| 1 | 1 |
| 1 | 0 |
| 0 | 1 |
| 1 | 1 |

Upon start-up, as in the above embodiment, the dye donor element will be moved until both photodetectors (42) and (43) yield logical signal 0. As can been seen from FIG. 3 and table 2, when both photodetectors (42) and (43) yield logical 0 (transparent) the yellow dye frame is positioned. The logical signal provided by photodetector (41) is then used to identify the type of donor element. If a red or green LED is used for LED (31) the logical signal provided by photodetector (41) will be 0 since the yellow dye frame that was positioned under LED (31) is transparent for a red or green LED. As was shown above using FIG. 2, a logical 1 yields when the frame was black. Consequently a dye donor element for color printing and one for black and white printing can be distinguished from each other.

Once detection of the yellow dye frame of a series of dye frames has been made color printing can start by first printing the yellow part of the image. Subsequently, the next dye frame, being magenta, has to be positioned under the thermal head. This is accomplished by making one of both detection areas (10) along the magenta dye frame opaque for LEDs (32) and (33) (see FIG. 3). Thus the dye donor element will be moved after printing the yellow part of the image until a logical signal 1 is provided by photodetector (42) and a logical signal 0 by photodetector (43). After printing the magenta part of the image, the dye donor element has to move until the cyan dye frame comes under the thermal head. This can be accomplished with the same type of detection areas as provided along the magenta dye frame and moving the dye donor element until a logical 1,0 is again detected. Detection of magenta and cyan with the same logical sequence is possible because once the leading dye frame has been detected together with the identification that the dye donor element is one for color printing, the printing system knows that after the leading dye frame two further dye frames follow. Consequently only positioning for the subsequent dye frames is necessary.

It can be seen from the above that one particular configuration of detection areas is not used i.e. one where the first detection area in the direction of movement is opaque and the other tranparent (reverse of the sequence along the magenta and cyan dye frame in FIG. 3). Thus in principal this sequence could be used to detect whether the dye donor element is for color printing or not. However the corresponding logical sequence (0,1) also occurs when the detection areas as shown in FIGS. 2 and 3 pass under LEDs (32) and (33) leading to a possible false detection of the type of dye donor element (see tables 1 and 2).

Also with the above embodiment detection of further variants of the dye donor element is not possible. The following two embodiments of the present invention allow for detection of such further variants.

Thus according to an alternative embodiment detection of the type of dye donor element may be carried out as follows (see FIG. 4). In FIG. 4 two variants of a dye donor element for black and white printing (FIGS. 4*a*–4*b*) are shown as well as two variants of a dye donor element for color printing (FIGS. 4*c*–4*d*). In FIG. 4 the vertical arcing indicates a magenta area (M) while the other arcing indicates black (B) or cyan (C). Upon start-up the dye donor element is moved until photodetector (43) provides a logical 0 (transparent) and the logical signal provided by photodetector (41) is then used to distinguish between dye donor element for color printing and one for black & white printing as described in the previous embodiment.

Figure 4B:
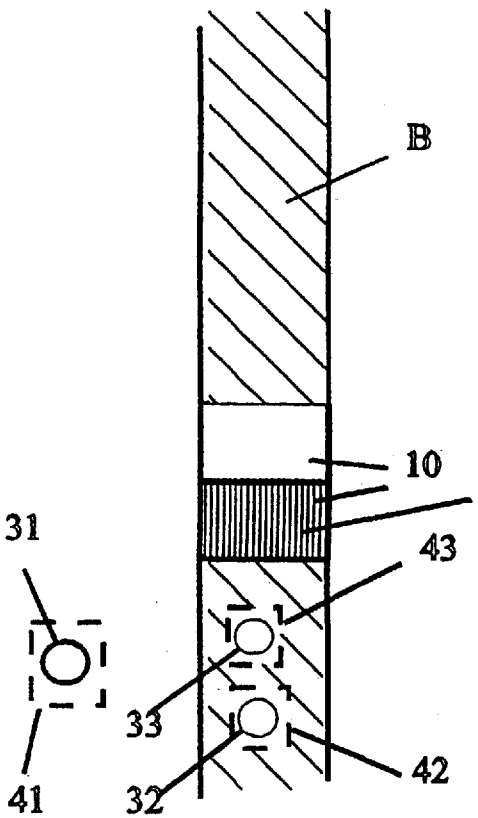
FIGS. 4*a* and 4*b* show variants of a dye donor element for black and white printing.
Figure 4A:
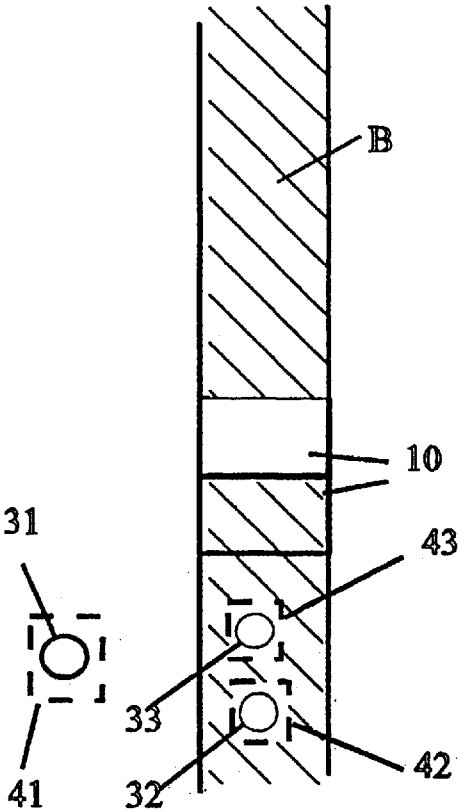
Figure 4D:
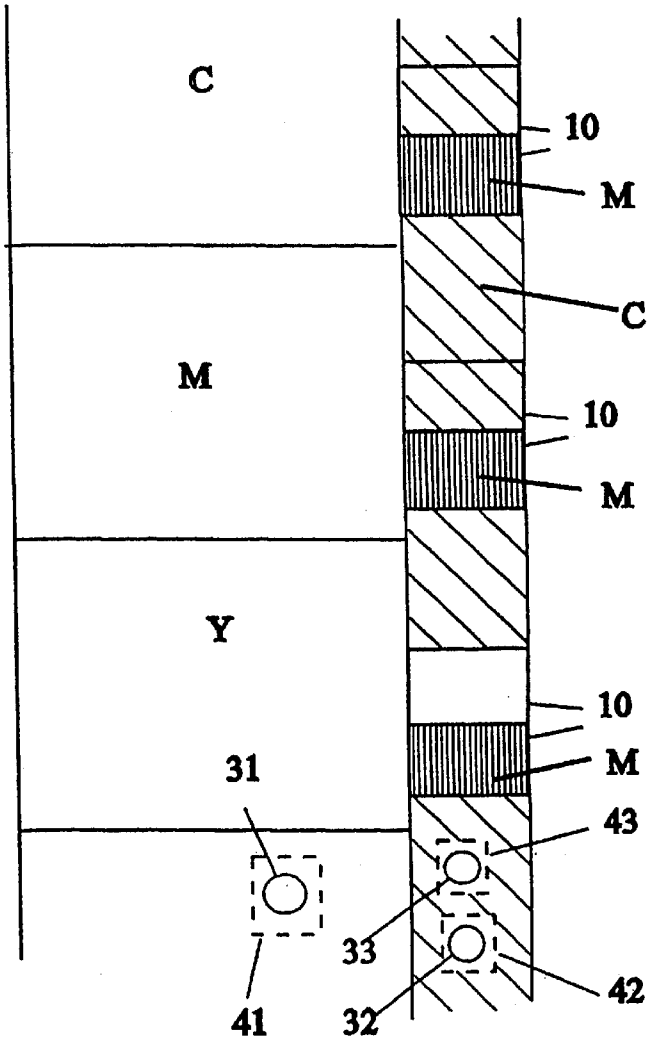
FIGS. 4*c* and 4*d* show variants of a dye donor element for color printing.
Figure 4C:
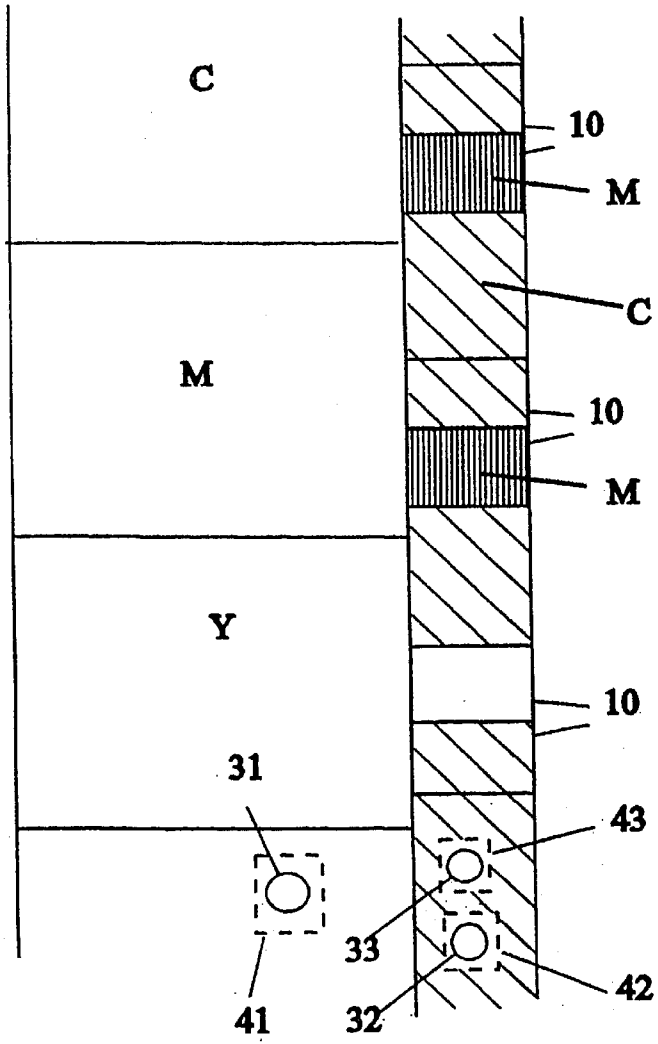

The logical signal provided by photodetector (42) can then used to detect further variants of a color dye donor element and black and white dye donor element (compare FIGS. 4*a* with 4*b* and 4*c* with 4*d*). This is accomplished by using LEDs emitting light of different frequency for (32) and (33) together with a detection area that is transparent only for light emitted by LED (32). For example a green LED may be used for (32) together with a magenta detection area additional to a detection area that is opaque for both LEDs (32) and (33). A red led may be used for LED (33). Photodetector (43) opposite to LED (33) will thus detect a magenta area as opaque as well as a further detection area e.g. cyan or black. Photodetector (42) on the other hand will only detect the latter detection area as opaque while the magenta detection area will be seen transparent.

Consequently when photodetector (43) yields logical 0 the dye donor element will be positioned relative to the different LEDs such that a second detection area (10) is illuminated by LED (32). At this point the logical signal provided by photodetector (42) can be used to distinguish between variants of the color dye donor element and black and white dye donor element as shown in FIGS. 4*a* to 4*d*. Depending on the logical signal of (42) one of both variants is detected. Positioning of the magenta and cyan dye frame after detection of the leading yellow dye frame in color printing can be done in a similar as described in the above embodiment using a detection area opaque for both LEDs (32) and (33) followed in the direction of movement by a detection area only seen transparent to LED (32).

Figures 5A, 5B:
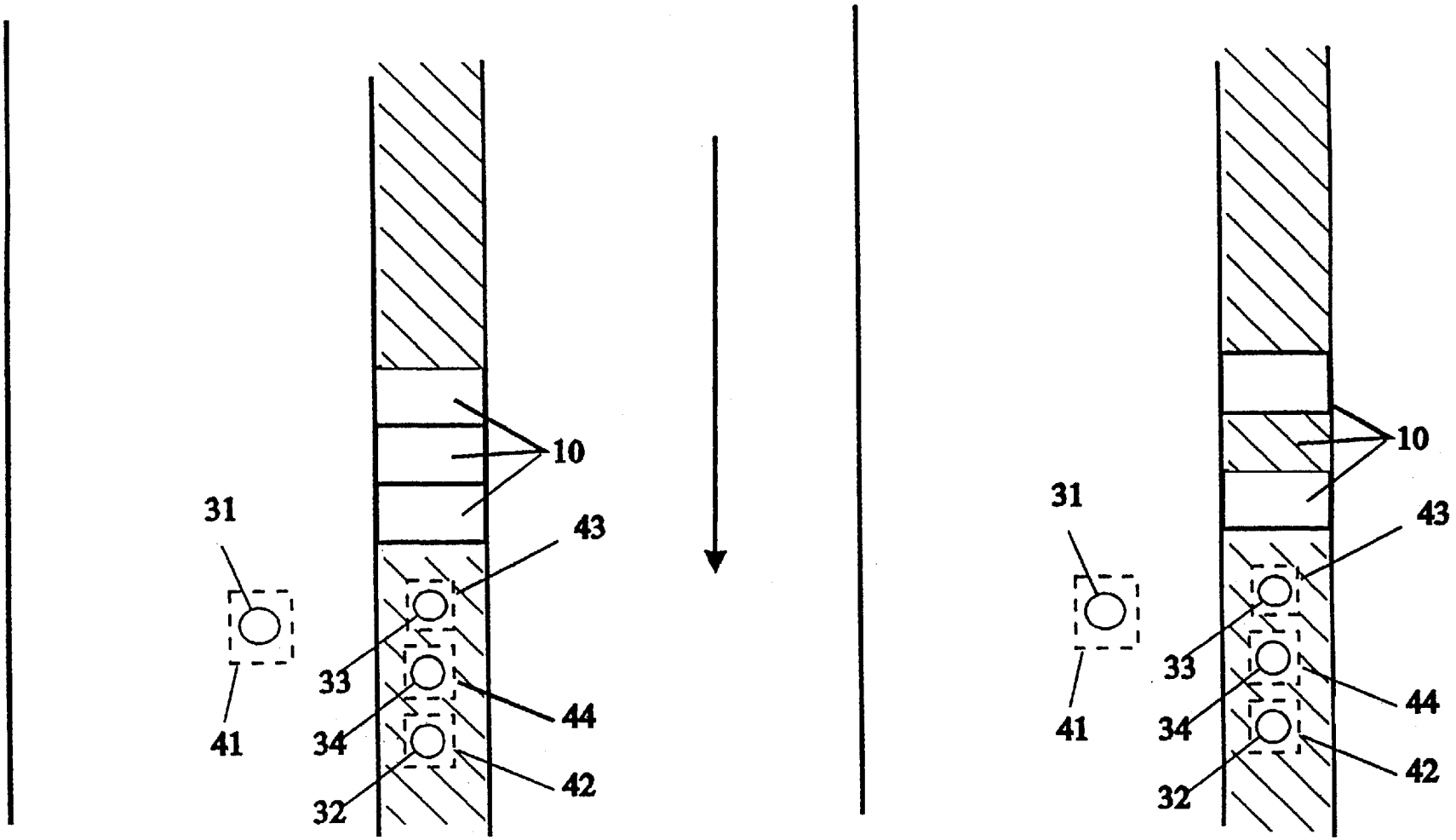
FIGS. 5*a* and 5*b* show variants of a black and white dye donor element of an alternative embodiment utilizing a logical signal provided by a photodetector which detects emitted light of a LED passing through the detection area of the dye donor element.

According to a further alternative embodiment of the present invention, shown in FIG. 5 a further LED (34) is provided inbetween LEDs (32) and (33). Opposite to LED (34) is provided a photodetector (44) for detecting the light emitted by LED (34) and passing through the detection areas (10) provided in the margin of the dye donor element. Photodetector (44) provides a logical 1 or 0 depending on whether or not the intensity of the detected light is above or below a threshold value.

Figure 5D:
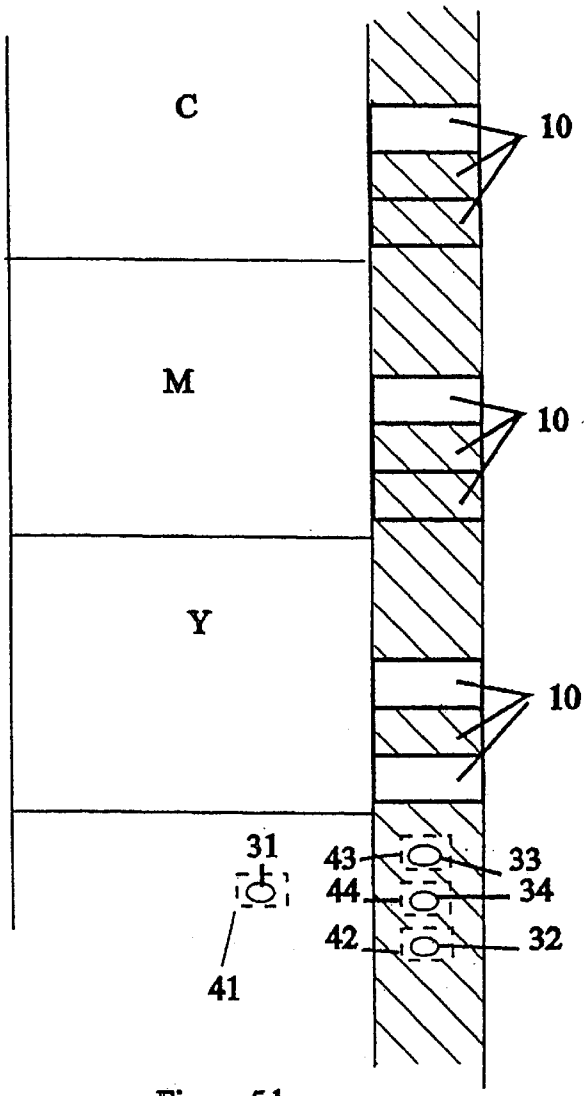
FIGS. 5*c* and 5*d* show variants of a color dye donor element of an alternative embodiment as described with respect to FIGS. 5*a* and 5*b*.
Figure 5C:
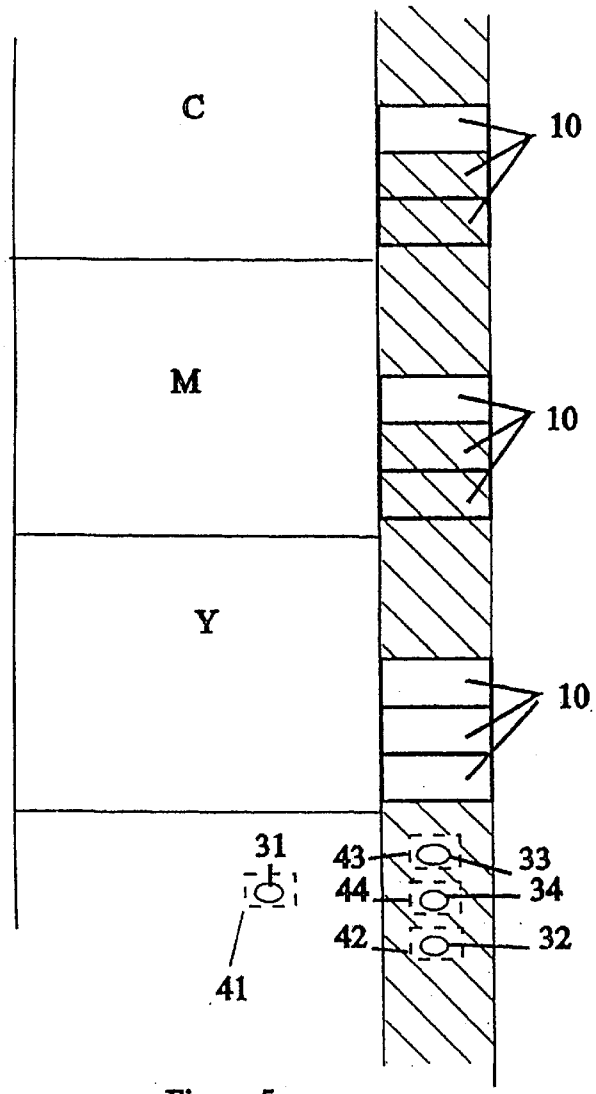

According to this embodiment upon startup, the dye donor element is moved until both photodetectors (42) and (43) provide the same logical signal 0 (transparent) (FIGS. 5*a*–5*d*). At this point detection whether or not the dye donor element is one for color printing or not can be detected by photodetector (41) as shown in the above embodiments. The logical signal provided by photodetector (44) detecting the emitted light of LED (34) passing through a detection area is used to further distinguish variants of a color dye donor element or black & white dye donor element as shown in FIGS. 5*a*–5*d*. If a color dye donor element has been detected, the necessary detection of subsequent dye frames (magenta and cyan) can be done using the logical signals provided by photodetector (42) and (44) as shown in FIGS. 5*c* and 5*d*. Thus once a yellow dye frame or magenta dye frame has been printed, the dye donor element is moved until both photodetectors (42) and (44) provide logical signal 1.

What is claimed is:

1. A thermal printing system including a printer which uses a dye donor element having one or more dye frames and a receiver which receives dyes from said dye frames, said printer including a print head, means for moving said dye donor element and receiver along respective paths so as to move a dye frame and the receiver relative to the print head such that as the print head is activated, dye from a dye frame is transferred to the receiver to form an image thereon characterized in that detecting means are provided for indentifying type of dye donor element and type of dye frame, said detecting means comprising:

a first light source disposed adjacent to the path of the dye donor element for illuminating a dye frame of the dye donor element two further light sources positioned in sequence and disposed adjacent to the path of the dye donor element for illuminating repetitive detection areas occurring at a regular distance in a margin of the dye donor element, said detection areas being transparent or opaque for one or both light sources a first photodetector disposed adjacent to the path of the dye donor element and opposite to said first light source, said first photodetector producing an electrical signal in response to the intensity of light emitted by said first light source and passing through said dye frame two further photodetectors positioned in sequence, disposed adjacent to the path of the dye donor element and each being opposite to one of said two further light sources, each of said two further photodetectors producing an electrical signal in response to the intensity of light emitted by the light source being opposite to it and passing through said detection areas each of said photodetectors producing a logical signal when an intensity is detected above or below a threshold value set for said photodetector and means responsive to said logical signals of said photodetectors for identifying the type of dye frame and type of dye donor element.

2. A thermal printing system according to claim 1 wherein said detecting means further comprises:

a fourth light source for illuminating said detection areas disposed adjacent to path of the dye donor element and positioned in sequence with the two other light sources for illuminating the detection areas a fourth photodetector disposed adjacent to the path of the dye donor element and positioned opposite to said fourth light source, said fourth photodetector producing an electrical signal in response to the intensity of light emitted by the fourth light source being opposite to it and passing through said detection areas said fourth photodetectors producing a logical signal when an intensity is detected above or below a threshold value set for said fourth photodetector and wherein means are provided responsive to the logical signals of all four photodetectors for identifying the type of dye donor element and type of dye frame.

3. A thermal printing system according to claim 1 wherein one of said two light sources for illuminating said detection areas emit light of different frequency.

4. A thermal printing system according to claim 1, 2 or 3 wherein said print head includes a plurality of selectively energizable heating elements.

5. A method for printing an image using a printing system as defined in claim 1 comprising the steps of:

advancing the dye donor element until the logical signals provided by the photodetectors being opposite to the light sources for illuminating the detection areas are the same and match a predetermined logical signal, subsequently using the logical signal provided by the photodetector opposite to the light source for illuminating the dye frame for detecting the type of dye donor element and printing an image taking into account the detected type of dye donor element.

6. A method for printing an image using a thermal printing system as defined in claim 2 comprising the steps of:

advancing the dye donor element until the same logical signals matching a predetermined logical are provided by the two photodetectors being opposite to the light sources illuminating the detection areas and which photodetectors are not adjacent to each other, subsequently using the logical signal of the photodetector in between said two photodetectors and the logical signal provided by the photodetector being opposite to the light source for illuminating a dye frame to detect the type of dye donor element and printing an image taking into account the detected type of dye donor element.

7. A method for printing an image using a thermal printing systems as defined in claim 3 comprising the steps of:

advancing the dye donor element until one of the photodetectors opposite to the light sources for illuminating the detection areas yields a logical signal that matches a predetermined logical signal, using the logical signals of the other two photodetectors to determine the type of dye donor element and printing an image taking into account the detected type of dye donor element.

* * * * *